United States Patent [19]

Marchisio

[11] 4,363,225

[45] Dec. 14, 1982

[54] CREEL FOR CIRCULAR KNITTING MACHINES

[75] Inventor: Giovanni Marchisio, Turin, Italy

[73] Assignee: Giovanni Marchisio & C. S.r.l., Turin, Italy

[21] Appl. No.: 188,156

[22] Filed: Sep. 17, 1980

[30] Foreign Application Priority Data

Sep. 17, 1979 [IT] Italy ..... 68825 A/79

[51] Int. Cl.[3] ..... D04B 15/40

[52] U.S. Cl. ..... 66/125 R; 242/131

[58] Field of Search ..... 66/125 R, 125 A; 242/131, 131.1

[56] References Cited

U.S. PATENT DOCUMENTS

| | | | |
|---|---|---|---|
| 116,677 | 7/1871 | Bradford | 242/131 X |
| 2,013,770 | 9/1935 | Stein et al. | 242/131.1 |
| 2,571,523 | 10/1951 | Bennett | 242/131 |
| 2,844,335 | 7/1958 | Freeze | 242/131.1 |
| 3,805,556 | 4/1974 | Planck, Jr. et al. | 66/125 R |
| 4,073,450 | 2/1978 | Carlsson et al. | 242/131 |

*Primary Examiner*—W. Carter Reynolds
*Attorney, Agent, or Firm*—Sughrue, Mion, Zinn, Macpeak & Seas

[57] ABSTRACT

The frame of a creel includes vertical support columns rigidly interconnected at their upper ends by a framework arranged so as to permit the frame to be positioned astride a circular-knitting machine with the columns disposed around the machine itself and with the framework at a height such as not to interfere with the movement of personnel about the machine. A vertically-movable slide is associated with each column, the slides being rigidly interconnected by a peripheral bobbin-carrier support structure. A driving device is provided for raising and lowering all the slides in unison in order to raise the peripheral structure to an upper position at a height at which it does not interfere with the movement of personnel about the machine and to lower it, respectively, to a lower position in which the structure surrounds the machine and is located at a height such as to allow manual access to bobbins which are on the bobbin-carrier.

5 Claims, 4 Drawing Figures

Figure 1:
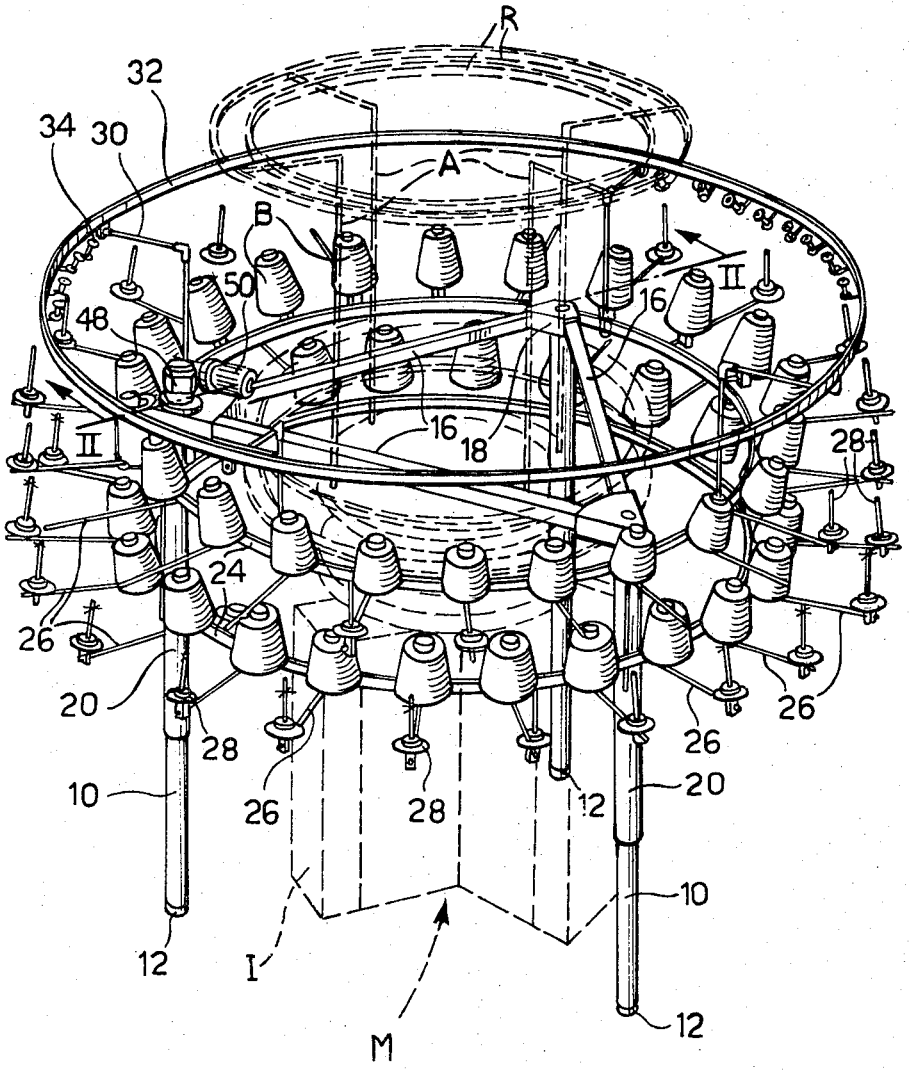

48
50
III
III
14
16
41
45
58
19
46
43
24
52
24
54
66
36
62
36
20
60
56
20
24
24
42
64
24
22
40
42
45
42
45
44
44
37
37
10
10
12
12

CREEL FOR CIRCULAR KNITTING MACHINES

The present invention relates to creels for supplying yarn to the yarn feeds of knitting machines and relates in particular to a creel for circular knitting machines, of the type comprising a frame which carries at least one horizontal row of bobbin carriers.

Modern circular knitting machines are being constructed with ever greater numbers of systems or yarn feeds for increasing the productivity of the machine, and consequently require an ever greater number of bobbins. Moreover, the need to reduce to a minimum the frequency at which the bobbins are replaced leads to the adoption of ever larger and heavier bobbins, as well as to an ever greater use of the so-called "head-to-tail" system in which each fall has a corresponding pair of adjacent bobbins, and in which the tail end of the yarn of one of the bobbins is connected to the leading end of the yarn on the other bobbin. The "head-to-tail" system allows bobbins to be changed without the machine ever being stopped since, whilst one bobbin of each pair is in use, being unwound, an operator can replace the empty bobbin with a new one.

The main result of the increase in the number and weight of the bobbins is that the bobbin-carrier becomes loaded with very considerable weights. For example, a machine with 72 yarn feeds (and machines exist with even 96, 120 and more yarn feeds) requires 144 bobbins. If bobbins of 3 kg are used (and bobbins of even 5 Kg exist) the weight carried by the bobbin carrier exceeds 400 kg.

In normal machines, in which the bobbin carriers are supported by an upper annular structure carried in its turn by the frame of the machine, the significant weight of the bobbins is borne directly by the machine itself causing deformation of the frame to the detriment of the centring of the machine. Since the bobbins must be located at a height of at least 1.80 m to permit free access to the zone immediately surrounding the machine, their replacement becomes rather inconvenient and tiring, especially if the bobbins are arranged in different concentric circles with rather limited spaced between them.

The said disadvantages, that is to say the excessive weight carried on the machine and the difficulty of replacement of the reels, are eliminated by the use of side-creels, which can be of various types. side creels, which are units entirely separate from the machine, have, however, other disadvantages of greater or lesser importance. The first of these is their bulk since the creels occupy a significant floor space on two sides of the machine. Since they are also loaded from their outer side with respect to the machine it is also necessary to leave a free corridor between one row of creels associated with one machine and a parallel row of creels associated with an adjacent machine.

Even modular creels, which are disposed around the machine, have significant bulk and constitute a considerable inconvenience for the associated personnel.

A second characteristic disadvantage of side creels is the notable difference in the distances between the upper most central bobbins and the lower side bobbins. This difference in distance affects the tension of the threads. In this connection it should be mentioned that the thread guides, that is, the points of introduction of the threads into the machine, are disposed in a circle, whilst the bobbins are arranged in lines at different heights and distances.

A third disadvantage lies in the fact that, in side creels, the bobbins are oriented with their axes horizontal so that the threads must undergo a change of direction 90° more than in the vertical axis arrangement characteristic of conventional reel carriers supported directly by the machine frame.

The object of the present invention is to eliminate all the said disadvantages.

To achieve this object, according to the present invention, there is proposed a creel of the type mentioned at the beginning, characterised in that the frame comprises vertical support columns rigidly interconnected at their upper ends by a framework arranged so as to allow the framework to be positioned astride the machine with the columns disposed about the machine itself and with the framework at a height such as not to interfere with the movement of personnel about the machine. A vertically-movable slide is associated with each column with the slides being rigidly inter-connected by a peripheral bobbin carrier support structure. Means are provided for driving raising and lowering movements of all the slides, in unison, in order to raise the peripheral structure respectively to an upper position at a height at which it does not interfere with the movement of personnel about the machine, and to lower it to a lower position in which the said structure surrounds the machine and is located at a height such as to allow manual access to the bobbins which are on the bobbin carriers.

In a creel according to the invention, the weight of the bobbins assembled in one set, or preferably several sets, around the peripheral structure does not bear on the machine. However the set or sets of bobbins are located entirely around the upper part of the machine, that is to say, their disposition is analogous to that of bobbins carried directly by the machine itself. By this arrangement the disadvantage of side creels, that is, differences in the distances between the bobbins and the thread guides of the machine, is eliminated.

The bobbin carriers can advantageously be mounted on the peripheral support structure in such a way that the axes of the bobbins are substantially vertical, as in the case of reels carried directly of the machine, so that the said supplementary change in direction of the threads, by 90° characteristic of conventional side creels, is eliminated.

Finally, perhaps the most important advantage of a creel according to the invention is that, in normal working conditions, all the equipment comprising the peripheral structure with its bobbins is located in an elevated position and the only obstacles around the machine are the columns. The bulk of these columns can be made entirely negligible since these columns can be very slender.

The possibility of lowering the said equipment when it is necessary to change the bobbins offers the further advantage that the bobbin can be lowered into a machine operator's reach without the operator having to mount a ladder, platform or the like. Moreover, since the lowering and raising of the bobbins causes merely an elongation and shortening of thread paths, and does not obstruct them in any way, the bobbins can, to advantage, be replaced without the machine being stopped and, hence, without any down time in the working of the machine.

Figure 2:
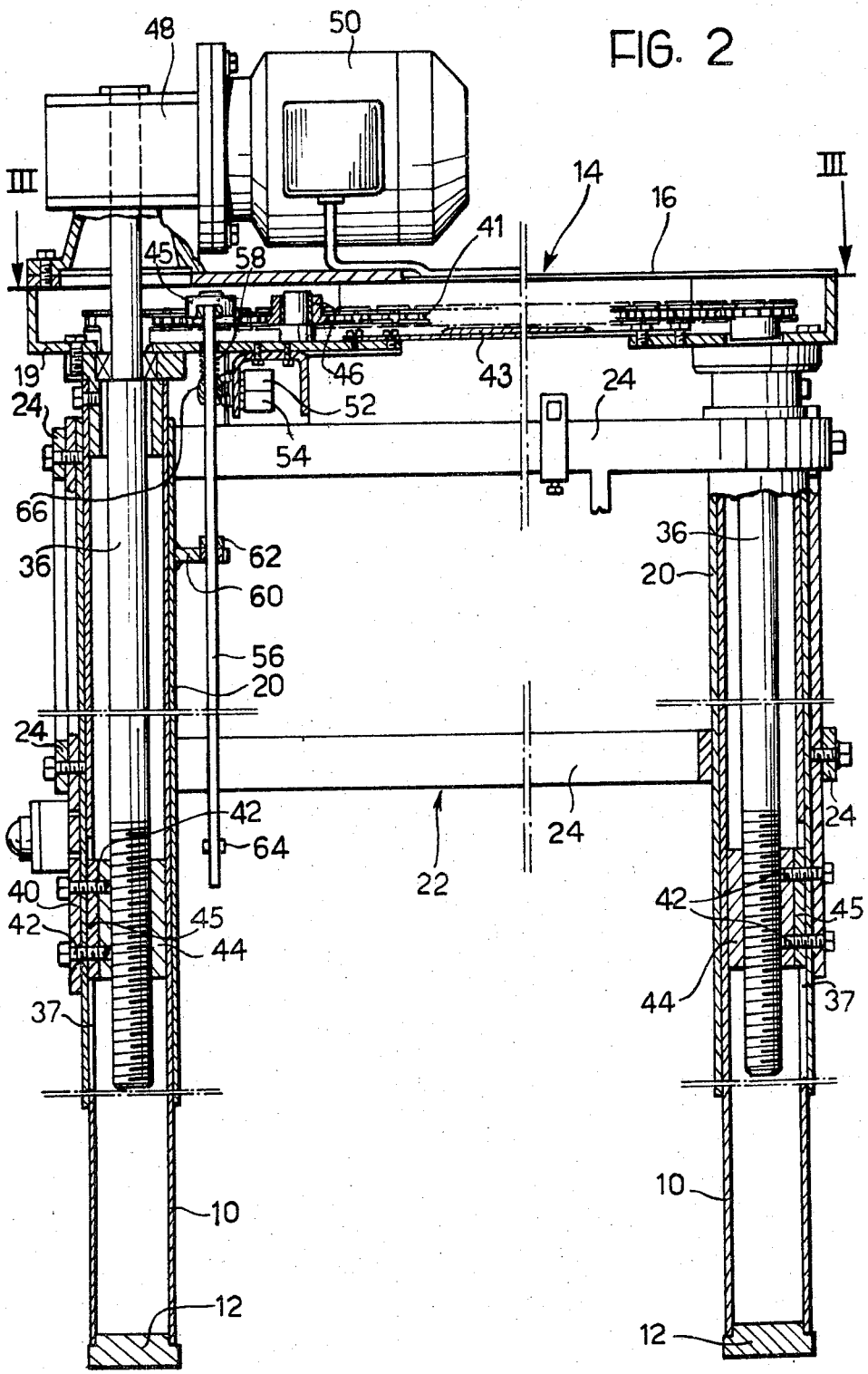
Figure 3:
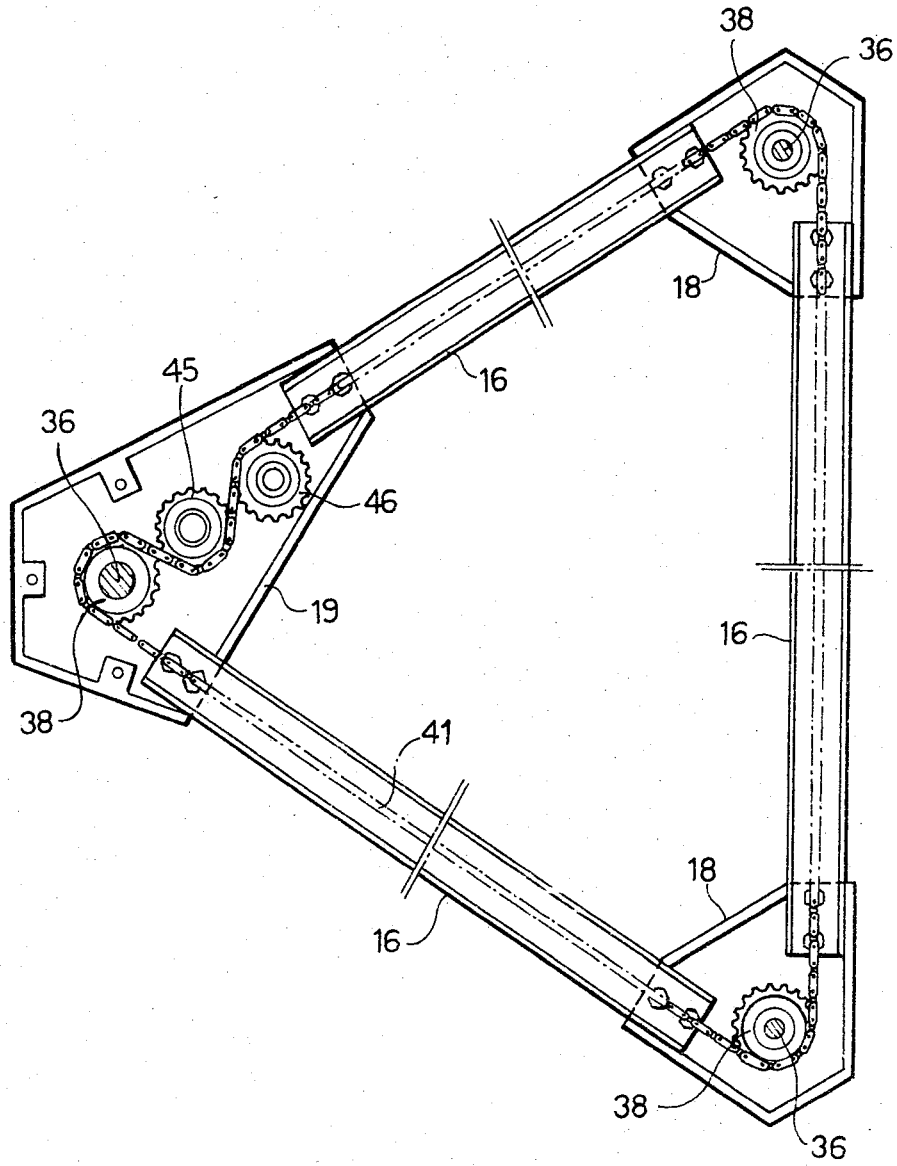
Figure 4:
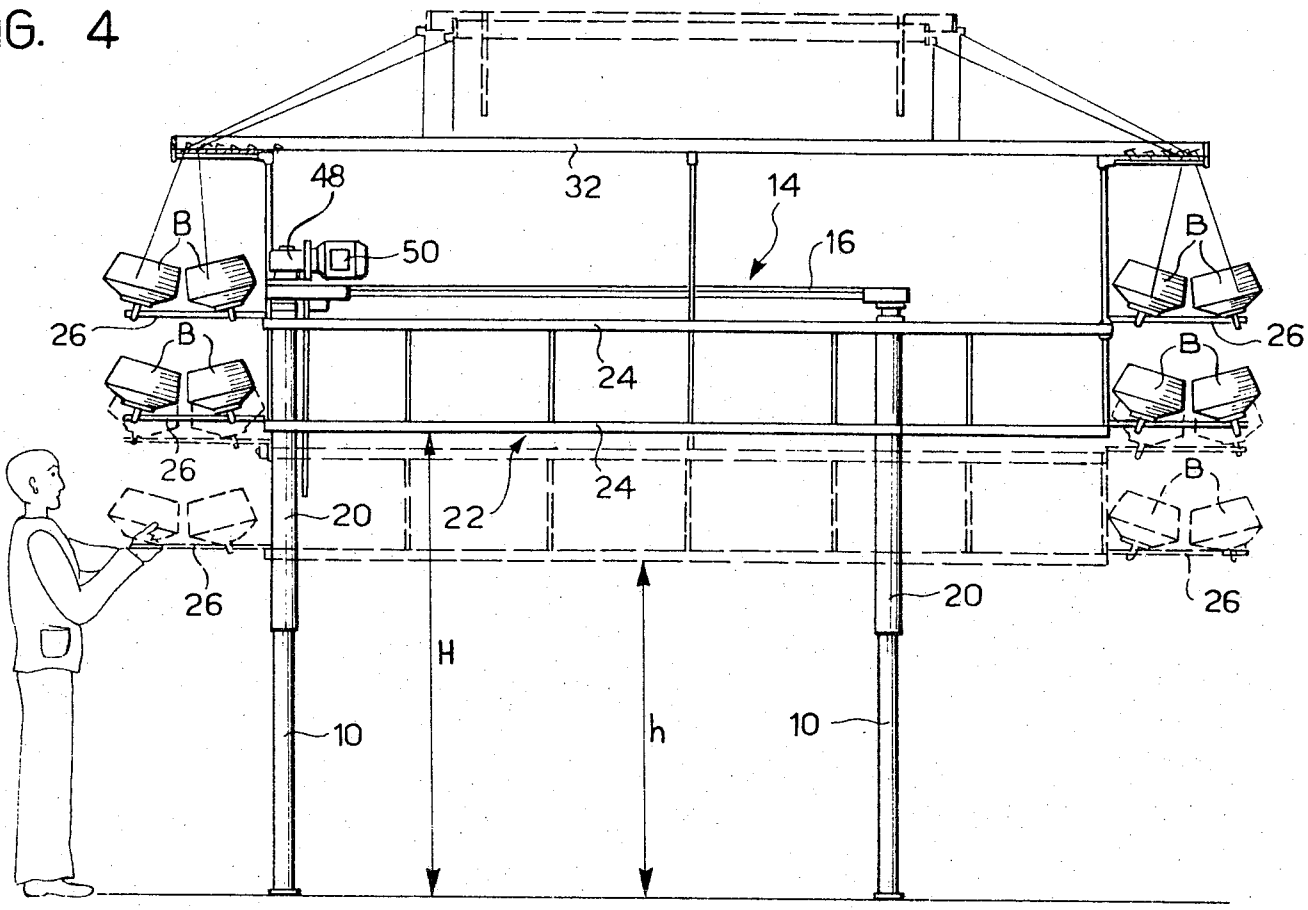

Further characteristics of the invention will become apparent from a reading of the following detailed description, made with reference to the appended drawings given purely by way of non limitative example, and in which:

FIG. 1 is a perspective view of a creel formed as a preferred embodiment of the invention, shown in association with a circular knitting machine, illustrated schematically in broken outline, FIG. 2 is a fragmentary section on an enlarged scale, taken on the vertical plane indicated II—II in FIG. 1, FIG. 3 is a fragmentary section taken on the horizontal plane indicated by the line III—III of FIG. 2, and FIG. 4 is a fragmentary side view of the creel.

In FIG. 1 there is schematically shown, in broken lines, a circular knitting machine generally indicated M, which includes, among other things, a frame I which supports, by means of vertical rods A, a system of annular rails R. The rails R, in turn, carry sets of thread tensioners (not shown).

Referring to FIGS. 1 to 4, a creel formed as a preferred embodiment of the invention includes a set of three vertical support columns 10 disposed at the edges of an equilateral-triangular prism. The columns 10 are constituted by slender tubular-metal elements having, for example, a diameter of the order 80 mm. Each column 10 is provided at its lower end with a ground-engaging foot 12.

The upper ends of the columns 10 are rigidly interconnected by a triangular framework 14 which comprises, among other things, a set of three horizontal box section beams 16, disposed along the sides of an equilateral triangle. Each pair of beams 16 is connected to a column 10 by means of a box-like connection plate. Two of these connection plates have been indicated by 18 in FIGS. 1 and 3, whilst the third connection plate, of different configuration, has been indicated by 19 in FIGS. 1 and 3 for reasons which will become apparent below.

The structure including the columns 10 and the framework 14 is intended to be positioned astride the machine M, as illustrated in FIG. 1.

As will readily be understood, the columns 10 constitute the only elements of the creel which occupy any floor space. This space is very little since the three columns 10 can be very slender, having a diameter of the order mentioned above. The height, or vertical length, of the columns is such that the framework 14 is located at a height such as not to interfere with the movement of personnel about the machine M.

Each column 10 is provided with a slide 20 constituted by a tubular metal sleeve, vertically movable along the column itself.

The sleeves or slides 20 are rigidly interconnected by a peripheral bobbin carrier support structure generally indicated 22. The structure 22 comprises, among other things, a pair of concentric circular rails 24, fixed to the sleeves 20 and located one above the other.

The rails 24 carry, in their turn, respective sets of rod-like arms 26 which project radially outwardly from the rails themselves. Each arm 26 carries a pair of adjacent bobbin carriers 28 which are radially spaced.

The preferred arrangement, shown in FIGS. 1 and 4, includes two vertically-spaced circular horizontal rows of bobbin-carrier pairs 28, the rows being arranged around the knitting machine. The bobbin carriers of each pair are radially adjacent to allow them to carry a pair of bobbins B usable alternately to supply one of the yarn feeds of the machine M according to the so-called "head-to-tail" system.

The said arrangement is not the only one possible, however, since it would also be possible to have more than two vertically-spaced circular horizontal rows of bobbin-carrier pairs arranged around a machine having a higher number of yarn feeds, or even a single row arranged around a machine having fewer yarn feeds.

In the illustrated arrangement, in which there are two vertically-spaced circular rails 24, the upper rail 24 carries, by means of rod-like brackets 30, a further circular rail 32 which, in turn, carries thread guides 34 through which pass the threads of the bobbins B before passing to the thread tensioners (not shown) carried by the uppermost rail R of the machine M.

The peripheral structure 22 is intended to be located normally at a height above that of a tall person. For example, the height H (FIG. 4) of the lower rail 24 from the ground may, in normal working conditions, be of the order of slightly more than 1.80 m. In this arrangement the bobbins B of the two vertically-spaced rows are practically inaccessible to a person standing on the ground, but no part of the peripheral structure 22 constitutes an obstruction to movement and to the working space around the machine M.

The creel is provided with means for driving the raising and lowering movements of all the sleeves 20 in unison in order to displace the peripheral structure 22 between the normal raised position, corresponding to the height H, and a lowered position, in which the same structure 22 surrounds the machine M and is located at a height such as to allow manual access to the bobbins B for the purpose of replacing these bobbins.

In FIG. 4 the raised position of the structure 22 has been shown in continuous lines whilst the lowered position has been shown in broken lines. In this latter position the lower rail 24 is located at a height h above the ground which is preferably of the order of 1.30 m. In these conditions the bobbins B of the lower row are located at about the height of the shoulder of a short operator, whilst the bobbins B of the upper row are located at head-height or slightly higher, and can also be reached by hand.

The preferred drive means for raising and lowering the movable members which make up the structure 22 will now be described with reference to FIGS. 1, 2 and 3.

In each tubular column 10 is rotatably, but not slidably, mounted a vertical threaded shaft 36. Each column 10 has, outwardly with respect to the frame, a vertical slit 37 over which extends a fillet 40 rigidly connected to the respective sleeve 20 by screws 42. The screws extend through the slit 37 into nut 44 and constitute members for rigidly fixing the respective sleeve 20 to a nut 44 slidably mounted within the column 10. A key member 45 is clamped by the screws 42 between the fillet 40 and the nut 44. The key member 45 is slidably engaged in the slit as an aid to prevent the nut from rotating. Each nut 44 is threadedly engaged with the threaded part of the respective shaft 36.

On the upper end of each shaft 36 there is keyed a respective toothed chain sprocket wheel 38. The sprocket wheels 38 are located within the respective box-like connector plates 18, 19 and their common generally horizontal plane is located at a mid level of the cavities of the box beams 16. The sprocket wheels 38 are interconnected by an endless transmission chain 41 the arms of which extend within the box beams 16 where they are supported by shoes such as 43 (FIG. 2) of material having a low coefficient of friction, such as polytetrafluroethylene or polyamide.

Within the box-like connector plate 19 there is also located a chain tensioner system which comprises a pair of sprocket wheels 45 and 46. The position of the sprocket wheel 45 is adjustable to adjust the tension of the chain 41.

As will be understood, the threaded shafts 36 and hence the nuts 44 and the three sleeves or slides 20 are interconnected by the chain 41 in such a way as to perform identical and simultaneous movements.

One of the threaded shafts 36 (that on the left in FIGS. 2 and 3) is extended upwardly and constitutes the output shaft of a worm screw reduction gear box 48. The reduction gear box 48 is carried by the box-like connection plate 19 and in turn carries a flanged reversible electric motor 50.

The motor 50, as will be understood, serves to drive the lowering and raising of all the movable members which make up the peripheral framework 22 carrying the bobbins B.

The upper and lower limits of the course of movement of the assembly, corresponding respectively to the heights H and h (FIG. 4) are defined by end-of-course switches. These switches are indicated by 52 and 54 in FIG. 2 and are rigidly connected to the connection plate 19, that is to say to the fixed frame-work 14.

The switches 52 and 54, which are of the push-button type, have associated therewith a vertical shaft 56 adapted to be displaced vertically but held in a fixed, unstable position by the force of two opposing springs 58. A striker lug 60 carried by the left hand sleeve 20 (FIG. 2) slides vertically on the shaft 56.

Above and below the lug 60 the shaft 56 carries two collars 62 and 64 the positions of which are adjustable along the length of the shaft itself. The shaft 56 also carries, adjacent the push-buttons 52 and 54, an olive-shaped cam 66 able to cooperate with these push-buttons. When, during a descending movement of the movable assembly, the striker lug 60 strikes the lower collar 64, the shaft 56 is thrust downwardly so that the cam 66 engages the push-button of the switch 54 stopping the assembly in the lowered position.

Similarly, on raising of the assembly, when the striker lug 60 engages the upper collar 62, the shaft 56 is thrust upwardly and the cam 66 engages the push-button 52 thus stopping the assembly in the raised position.

The lowering and raising of the movable assembly and of the bobbins B, whilst the machine M is in operation, merely lengthens or shortens the path of the threads which are being unwound from the bobbins B, leaving the threads themselves still with the correct tension for knitting. This allows the replacement of the bobbins B without the machine being stopped.

If the raising movement were to take place with the machine stopped, the threads of the various yarn feeds could become entangled. To avoid this inconvenience, a gating system is interposed in the electrical control circuit for the motor 50 which prevents the raising of the movable assembly when the machine M is not working.

The main advantages of a creel according to the invention have already been mentioned in the introduction. A further advantage of the arrangement illustrated lies in the fact that, by adequately dimensioning the circle on which the bobbins B lie, that is the diameter of the rails 24 and of the cylinder in which the axes of the columns 10 lie, it is possible to leave sufficient space between the rails 24 and the machine M, when the bobbins B are in the lowered position, for the innermost bobbins to be replaced by an operator positioned between the rails 24 and the machine M with greater ease than if the operator had to replace the innermost bobbins from an outer position. This characteristic is on the other hand also allowed by the fact that the diameter of the circle on which the innermost reels B lie is not limited by considerations of size, given that, in normal operation, the whole of the movable assembly is located at a height at which it does not interfere with the movement of personnel about the machine.

Naturally, the creel is susceptible of different variations within the same principle of the invention. Thus, the slides associated with the columns could have a different configuration from the sleeves and also the drive means for their movement could be different from the screw and nut system illustrated. Thus also, the reversible electric motor 50 could be replaced by a source of movement of different type, such as for example an hydraulic motor.

What is claimed is:

1. A creel for use with a circular knitting machine, said creel comprising a frame carrying a plurality of bobbin-carriers arranged in at least one horizontal row adapted to extend around said knitting machine, wherein said frame includes:

a plurality of vertical columns adapted to be disposed around said knitting machine, each said column being tubular and having a vertical slit therein;

a framework rigidly interconnecting the upper ends of said columns at a height such as not to interfere with the movement of personnel about said knitting machine;

a respective slide comprising a sleeve surrounding and slidable vertically along, each said column;

a bobbin-carrier support structure supporting said bobbin-carriers and surrounding and rigidly interconnecting said slides; and drive means connected to said slides to effect the sliding movement thereof between an upper position, in which said bobbin-carrier support structure is located at a height such as not to interfere with the movement of personnel about said knitting-machine, and a lower position in which said bobbin-carrier support structure is adapted to surround said knitting-machine and is located at a height such as to allow manual access to said bobbin-carriers, said drive means comprising respective, vertical, screw-threaded shafts housed one in each said tubular column for rotation therein, said shafts being constrained against vertical sliding movement;

respective internally screw-threaded nuts engaged one with each said screw-threaded shaft, each said nut being slidable in a respective said column;

connecting means rigidly connecting each said nut with the sleeve surrounding the respective column, said connection means extending through the vertical slit in the column;

respective sprocket wheels keyed one to each said shaft;

an endless transmission chain engaged with and interconnecting said sprocket wheels;

a reversible motor connected to drive said transmission chain.

2. The creel of claim 1, wherein said reversible motor is carried by said framework adjacent one of said columns and is coupled to the threaded shaft housed within said one of said columns to effect said rotation thereof.

3. The creel of claim 1 or claim 2, wherein said framework comprises a plurality of box beams, each said box beam extending horizontally and interconnecting an adjacent pair of said columns, and wherein said endless chain is housed and circulates within said box beams.

4. The creel of claim 1, wherein said bobbin-carrier support structure comprises at least one continuous, circular rail carried on the radially outer sides of said slides, said at least one rail supporting a plurality of radially-outwardly projecting arms supporting said bobbin-carriers.

5. The creel of claim 1, wherein said bobbin carriers are arranged in at least two vertically-spaced apart sets of adjacent bobbin-carrier pairs, each set of bobbin-carrier pairs being located on a respective pair of concentric circles around said knitting machine, one bobbin-carrier of each said bobbin-carrier pair being located on each of said concentric circles, and wherein each bobbin-carrier pair carries a pair of bobbins arranged to supply a respective yarn feed of the knitting machine alternately.

* * * * *